United States Patent [19]

Shimoma et al.

[11] Patent Number: 4,490,644

[45] Date of Patent: Dec. 25, 1984

[54] MAGNETIC FOCUSING TYPE CATHODE RAY TUBE

[75] Inventors: Taketoshi Shimoma, Isezaki; Kumio Fukuda; Toshio Shimaoogi, both of Fukaya, all of Japan

[73] Assignee: Tokyo Shibaura Denki Kobashiki Kaisha, Japan

[21] Appl. No.: 411,360

[22] Filed: Aug. 25, 1982

[30] Foreign Application Priority Data

Sep. 2, 1981 [JP] Japan ..... 56-137002

[51] Int. Cl.[3] ..... H01J 29/51; H01J 29/64

[52] U.S. Cl. ..... 313/413; 313/414; 313/412; 313/442; 313/443

[58] Field of Search ..... 313/413, 414, 442, 443, 313/440, 412

[56] References Cited

U.S. PATENT DOCUMENTS

| | | | |
|---|---|---|---|
| 3,866,080 | 2/1975 | Barkow | 313/412 |
| 4,310,780 | 1/1982 | Sakurai et al. | 313/412 |
| 4,362,964 | 12/1982 | Sakurai et al. | 313/412 X |
| 4,401,917 | 8/1983 | Gerritsen | 313/413 |

FOREIGN PATENT DOCUMENTS

| | | | |
|---|---|---|---|
| 55-1059 | 1/1980 | Japan | 313/442 |
| 56-50038 | 5/1981 | Japan | 313/413 |
| 56-103851 | 8/1981 | Japan | 313/413 |
| 1502011 | 2/1978 | United Kingdom . | |
| 2079530 | 1/1982 | United Kingdom | 313/442 |

*Primary Examiner*—David K. Moore
*Assistant Examiner*—Vincent DeLuca
*Attorney, Agent, or Firm*—Cushman, Darby & Cushman

[57] ABSTRACT

A magnetic focusing type cathode ray tube comprising a magnetic focusing device positioned in front of a three beam in-line type cathode for focusing the electron beam emitted from the cathode. The magnetic focusing device is constructed of a magnetic yoke assembly having a pair of magnetic yoke members. Each magnetic yoke member has three cylindrical magnetic yoke portions through which an electron beam can pass, and one common cylindrical magnetic yoke portion having a larger diameter which completely surrounds the three electron beam passages. The cylindrical magnetic yoke portions of the yoke members are spaced equidistantly, facing each other in the electron beam passages.

6 Claims, 11 Drawing Figures

MAGNETIC FOCUSING TYPE CATHODE RAY TUBE

BACKGROUND OF THE INVENTION

This invention relates to a magnetic focusing type cathode ray tube which employs a magnetic yoke for shaping the focusing magnetic field to improve focusing thereof.

Generally, the focusing means for a cathode ray tube is categorized as either an electrostatic focusing type or as a magnetic focusing type. Of these focusing means, the electrostatic focusing type has been more widely used. However, the magnetic focusing type cathode ray tube has better resolution. Further, a higher supply voltage for focusing is not required. Therefore, a power source circuit associated with the magnetic focusing type cathode ray tube may be simplified, and the electrical insulation means with respect to the higher voltage may be also simplified. This brings out the possibility that reliability of the magnetic focusing type cathode ray tube could be improved and thus its production cost reduced. For these reasons, much effort has been recently made to improve the magnetic focusing type cathode ray tube.

The magnetic focusing type cathode ray tube generally employs an electron gun in the magnetic focusing lens system. The electron gun is constructed by a cathode member and a focusing magnetic yoke assembly. In the in-line type electron gun, for example three cathodes for red, blue and green are arranged in an in-line fashion, and a pair of magnetic yokes having electron beam passing holes corresponding to the cathodes are disposed in a face-to-face manner. The pair of magnetic yokes are coupled with a pair of permanent magnets. The permanent magnets are vertically arranged over the central electron beam path. The N pole of the magnet is closer to the cathode side; and the S pole of the magnets is closer to the screen side of the tube. Each magnetic yoke is provided with cylindrical magnetic elements which protrude from the periphery of the electron beam passing holes.

In an electron gun thus constructed, magnetic flux from the N pole of the permanent magnets passes into the cylindrical magnetic element of the yoke closest to the N pole. The magnetic flux then passes through the other cylindrical magnetic elements of the yoke closest to the S pole, and afterwards returns to the S pole of the permanent magnets. In this way, a focusing magnetic field is generated in the magnetic gaps between the cylindrical magnetic elements of the opposite magnet yokes. All together, three focusing magnetic fields are formed to control each of the three electron beams. Ideally, perfect focusing can be attained only by the focusing magnetic fields of the permanent magnets. Actually, however, other external magnetic fields exist in the cathode ray tube. For example, there is a magnetic field directed from the yoke closest to the N pole side, i.e., the cathodesided yoke, to the cathode itself, and there is another magnetic field directed from the screen to the yoke closest to the S pole side, i.e., the screen-sided yoke. Under the influence of such external magnetic fields, the side electron beams, e.g., the beams for red and green phosphor dots are deflected vertically with respect to the beam path.

One of the most important aspects when the magnetic focusing means is employed for the CRT such as a color picture tube having a plurality of electron guns, resides in the convergence of the three electron beams at the center of the screen. As the result of the undesirable deflection, when the three electron beams are concentrated by a ring-like 4-pole magnet mounted around the screen sided neck portion, the beam spot on the screen forms an ellipsoid, thus degradating the focusing quality. cl SUMMARY OF THE INVENTION Accordingly, an object of the present invention is to provide a magnetic focusing type cathode ray tube with a magnetic field shaping yoke assembly for shaping a focusing magnetic field so as to have a proper beam spot.

According to the present invention, a cylindrical yoke portion for each electron gun and a common yoke portion surrounding all beam paths for a plurality of electron beams are used for the magnetic field shaping yoke assembly.

With this arrangement, a focusing magnetic field on the passage area of the three electron beams can be distributed uniformly. The radial direction magnetic field component can be reduced. The disturbance resulting from the convergence of electron beams in the center of the screen can also be reduced. As a result, a better beam spot can be obtained on the screen, and the focusing can be improved.

DETAILED DESCRIPTION OF THE PREFERRED EMBODIMENT

Figure 1:
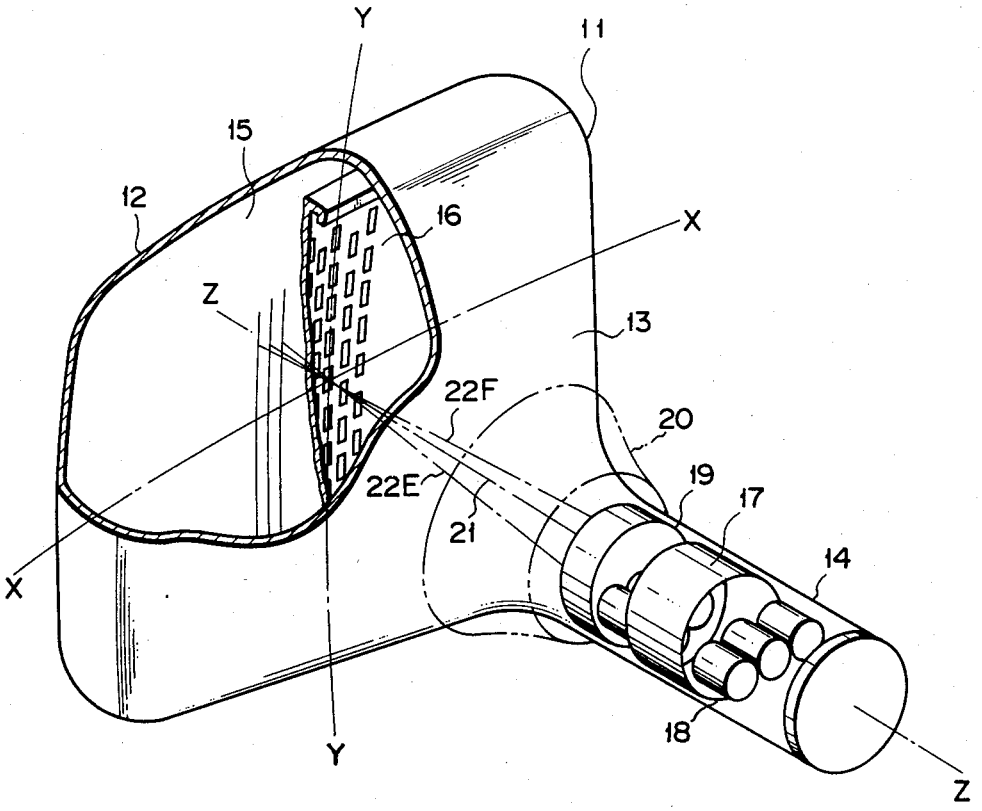
FIG. 1 shows a schematic perspective view of the magnetic focusing type cathode ray tube according to the invention.

In FIG. 1, a glass envelope 11 for a cathode ray tube is shown. The glass envelope 11 has along its Z axis a faceplate 12, a funnel portion 13 and a neck portion 14 which are all made integral with the faceplate 12. A black striped phosphor screen 15 is formed on the inner surface of the faceplate 12. A slotted shadow mask 16 is provided facing the screen 15. An electron gun 17 is accommodated in the neck portion 14. The electron gun 17 has three cathodes 18 arranged in an in-line fashion. A magnetic yoke assembly 19 is provided in the front of the electron gun 17. A deflection coil 20 is fitted around the transition part between the funnel portion 13 and the neck portion 14.

In FIG. 1, the traveling direction of the electron beam is represented by the Z axis, a horizontal direction by an X axis, and the vertical direction by a Y axis. Accordingly, the in-line type cathode is arranged along the X axis.

One of the features of the present invention resides in the magnetic yoke assembly 19 as shown in FIG. 1.

Figure 2:
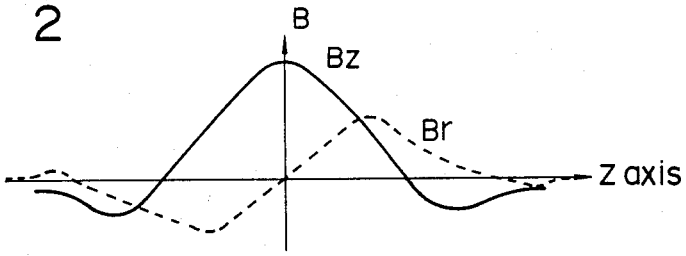
FIG. 2 is a graph for indicating the distribution of the magnetic field along the electron beam axis.

For a better understanding of the present invention, consider that an electron beam passes through a magnetic field developed by a permanent magnet disposed is a symmetrically rotational fashion with respect to the beam path or the Z axis. The distribution of the magnetic field of the cylindrical magnet traveling along the beam path or the Z axis is shown in FIG. 2. In the graph of FIG. 2, the abscissa represents the beam path (or the Z axis), and the ordinate represents magnetic flux density B. On the Z axis, the cathode 18 is located to the left of the graph and the screen 15 is on the right. "Bz" indicates the flux density distribution in the Z direction on the center axis of the cylindrical magnet; Br indicates the flux density distribution in the radial direction along the axes which are set at a given distance from the center axis and are parallel to the center axis, i.e. on the traveling paths of the side beams. In this case, the maximum value of Bz is approximately 800 Gauss.

Figure 3:
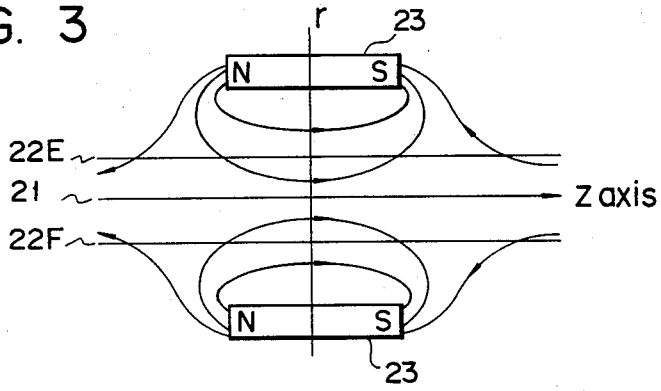
FIG. 3 is a schematic representation of the magnetic flux distribution of the permanent magnet.
Figure 4:
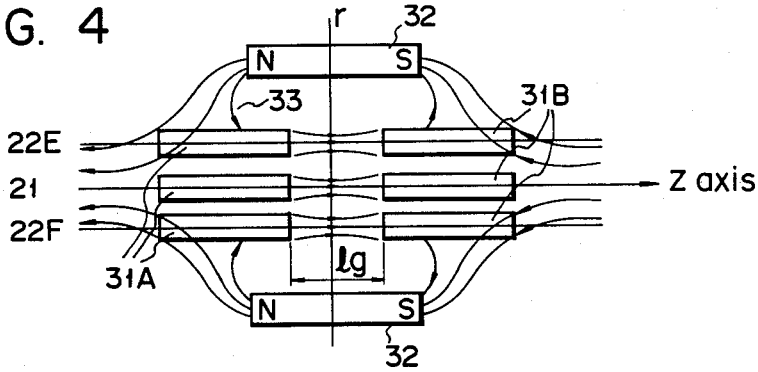
FIG. 4 is a schematic representation of the magnetic flux distribution where the conventional three magnetic yokes have been inserted.

FIG. 3 illustrates electron beam axes, and the distribution of magnetic flux in a plane where three cathodes 18 are arranged, that is, a plane parallel to the X axis. As seen from the figure, the center beam 21 travels in a parallel direction to the Z axis along the center axis of the permanent magnet 23. In this case, only the Bz component exists (Br=0) on the center beam axis. Therefore, the center beam 21 is not subjected to an undesired deflection. On the other hand, the Br component is present in the paths of the side beams 22E and 22F. After having received a velocity component in the rotation direction, both side beams 22E and 22F enter into the center direction of the permanent magnet 23. As a result, as explained in FIG. 2, an intensive magnetic field component Bz exists in the center of the permanent magnet 23, so that the rotation directional velocity and the magnetic field component Bz in the Z axial direction cooperate to deflect the side beams in the radial direction. Thus, the side beams 22E and 22F are undesirably deflected in the radial direction and also in a rotation direction, so that the convergence of the three electron beams is greatly disturbed. For applying a uniform focus magnetic field to the three electron beams, a pair of cylindrical yokes 31 made of ferromagnetic material could be arranged, as shown in FIG. 4. One group of cylindrical yokes 31A is arranged coincident with the three electron beam axes 21, 22E and 22F, while another group of cylindrical yokes 31B is spaced so it is facing the former group of yokes 31A at a given distance $1_g$. With this arrangement, the electron beam can pass through the corresponding groups of the cylindrical yokes 31A and 31B. The magnetic flux 33 emitted from the N pole of the permanent magnet 32 which is symmetrically rotational to the Z axis, enter one group of the cylindrical yoke 31A, and concentrate in the gap between the yokes to develop a uniform magnetic field parallel with each of the beam axes. These magnetic force lines 33 next enter the other group of the yokes 31B facing the former yoke group 31A and finally return to the S pole of the permanent magnet 32, thereby forming one magnetic circuit.

Figure 5:
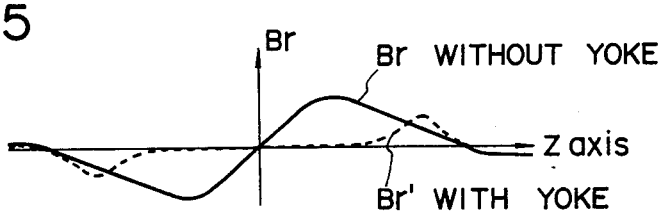
FIG. 5 is a graph for indicating the magnetic field distribution for the conventional magnetic yokes of FIG. 4.

Because the cylindrical yokes 31A and 31B are placed along the beam paths, the radial components Br of the magnetic field for the side beam axes 22E and 22F (shown by a broken line) are greatly reduced (see FIG. 5). As seen from FIG. 5, the other radial components Br' are, however, peculiarly rasied at the edges of the magnetic yokes 31A and 31B on the cathode and screen sides. This is caused by the edge effect resulting from the fact that the electron beams and the magnetic yokes are located too close to each other, and by the fact that magnetic flux intersects the side electron beams since the yoke for the center beam is positioned within the yoke area for the side electron beams. Due to existence of such a radial component focusing of the beams is difficult.

Figure 6:
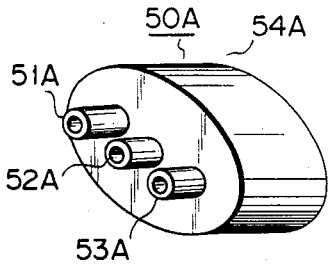
FIG. 6 shows a schematic perspective view of one embodiment of the magnetic yoke member according to the invention.

FIG. 6 shows an embodiment of a pair of magnetic yoke members 50A, 50B assembled according to the present invention. For simplicity of illustration, only one magnetic yoke member 54A is shown. The numerals 51, 52A and 53A indicate three separate cylindrical hollow magnetic portions which serve as the cylindrical magnetic yoke portion in which the longitudinal lines correspond to the three electron beam paths. The cylindrical magnetic portions are made of permalloy. Each has a protrusion 2.0 mm in length and 4.0 mm in its outer diameter. A common cylindrical magnetic yoke portion 54A made of permalloy which surrounds all beam paths has a diameter of 15.0 mm and a length of 10.0 mm. Accordingly, the electron beams may pass through the center portions of the three cylindrical magnetic members 51A, 52A and 53A.

Figure 7:
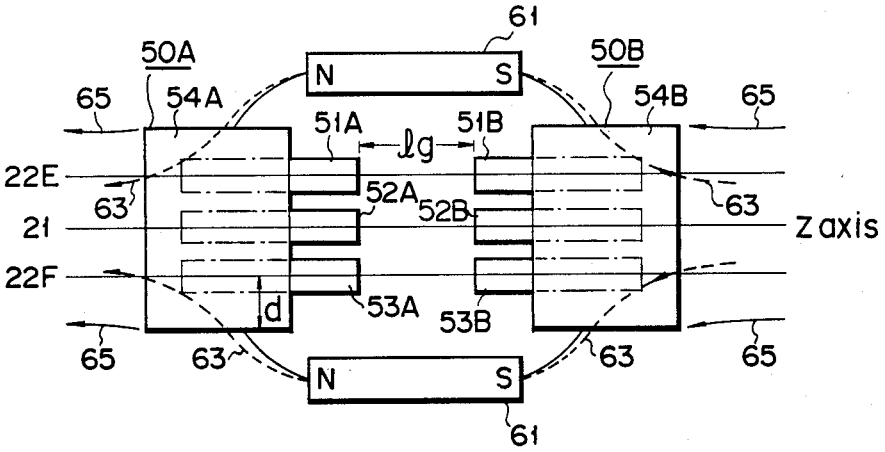
FIG. 7 is a schematic representation of the magnetic flux distribution in the magnetic yoke member shown in FIG. 6.

FIG. 7 shows a schematic representation of the magnetic flux distribution of the magnetic yoke assembly 50 according to one embodiment of the present invention. In this figure, one magnetic yoke member 50B (which is the counterpart of the magnetic yoke member 50A in FIG. 6) is spaced at a given distance $1_g$ from the latter along the Z axis in a face-to-face fashion, and vice versa.

A cylindrical permanent magnet 61 for the focusing magnetic field disposed in a symmetrically rotational fashion with respect to the Z axis is parallel to either the beam paths or the Z axis. It is magnetized so that the N pole is closest to the cathode side and the S pole is closest to the screen side, as illustrated. The pair of magnetic yoke members 50A and 50B are arranged such that the electron beams axes 21, 22E and 22F may pass through the cylindrical magnetic portions 51A, 51B, 52A, 52B, 53A and 53B, respectively as shown in FIG. 4. Specifically, the cylindrical common magnetic yoke portions 54A and 54B do not contain any magnetic members. Each of their outer edges is placed equidistantly at a distance d from the side beam axes (22E and 22F). Also, both the magnetic yoke members 50A and 50B are arranged along the beam axes having distance $1_g$ in such a way that the edges of both magnetic yoke portions 51A, 51B; 52A, 52B and 53A, 53B are aligned with the electron beam axes 21, 22E and 22F. For a better understanding of the principle of the present invention, the location of the individual yokes 31A and 31B in FIG. 4 is indicated by a dot and broken line in FIG. 7.

As described above, when using the common cylindrical yoke portions 54A, 54B, the magnetic flux is deflected away from the electron beams, as indicated by a solid line 65. When using the conventional three individual cylindrical yokes 31A and 31B, as shown in FIG.

4, the magnetic flux traveling from an infinite point and going to the infinite point are distributed as indicated by broken line 63. Consequently, in the case of the present invention, the magnetic flux is reduced in the vicinity of the paths of the electron beams. The radial magnetic field component (BR') on the side beams can also be reduced. Thus, the common magnetic yoke portion can reduce the magnetic field directed toward the infinite point near the electron beam axes and can also reduce the radial magnetic field component. Therefore, an excellent focusing magnetic field can be attained.

While the present invention has been described using specific embodiments, it should be understood that further modifications and changes can be made without departing from the scope of the present invention.

Figure 8:
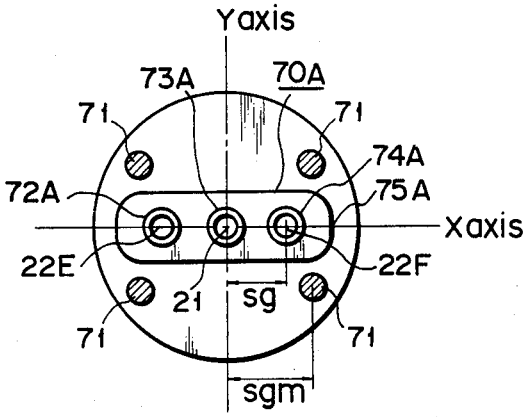
FIG. 8 shows a schematically illustrated front view of another embodiment of the magnetic yoke member according to the invention.

For example, the radial magnetic field component can be extremely reduced by using permanent bar magnets. In this case, four permanent magnets 71 are sandwiched between both side beams 22E and 22F in such a way that the distance Sg between the center beam and one of the side beams is shorter than the distance Sgm between the Y axis and each permanent magnet 71, as illustrated in FIG. 8.

Also in this case, as in the previous case, in addition to the individual yoke portions 72, 73 and 74, a couple of common yoke portions 75 can be provided to reduce the radial components of the permanent magnets 71 in the Z axes.

Figure 9:
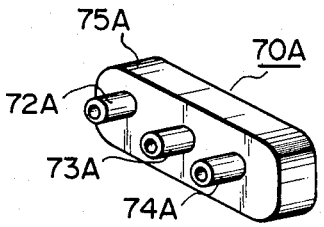
FIG. 9 shows a schematic perspective view of the magnetic yoke member shown in FIG. 8.

As illustrated in FIG. 9, one common yoke portion 75A has a flattened oval shape.

Figure 10:
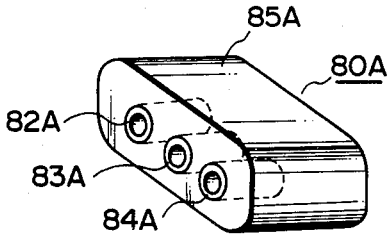
FIGS. 10 and 11 show a schematic perspective view of further embodiments of the magnetic yoke member according to the invention.

In FIG. 10, a modified magnetic yoke assembly is illustrated in which the individual cylindrical yoke portions 82A, 83A and 84A are embeded in the corresponding common yoke portion 85A.

Figure 11:
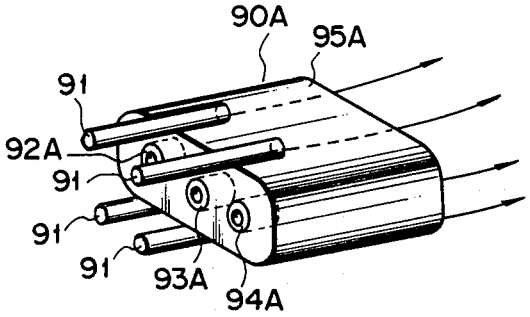

If the distance 2Sgm between the adjacent permanent magnets is smaller than the distance 2Sg between the side beams, the magnetic flux emitted from the permanent magnet 91 toward an infinite point are shielded by the common yoke portion 95A, so that the radial magnetic field components (Br') at the side beam positions can be remarkably reduced, as shown in FIG. 11. Similarly in both FIGS. 10 and 11, only one piece of the pair magnetic yoke portions 80A and 90A is shown. According to the experiment where the length of the common yoke portion 95A is substantially equal to that of the permanent magnet, the ratio of the flux density Br to Bzc at the midpoint between the pair of the yokes oppositely disposed along the beam axes, i.e., the Br/Bzc, was 1% or less inside the yoke portion and approximately 3% in the vicinity of the edges of the yoke portion.

As described above, in accordance with the invention the common yoke portions entirely surrounding the three electron beams are provided in addition to the individual cylindrical yoke portions the electron beam paths in the magnetic focusing type cathode ray tube. This arrangement can make the magnetic field distribution in the passing area of electron beams highly uniform. As a result, the radial magnetic component of the focusing magnetic field can be reduced and the disturbance of the convergence of both side electron beams at the center of the screen can be significantly diminished. Thus, a magnetic focusing type cathode ray tube with a better beam spot can be realized according to the present invention.

What we claim is:

1. A magnetic focusing type cathode ray tube comprising:

a glass envelope including a faceplate on which a screen is formed, a funnel portion integral with said faceplate, and a neck portion integral with said funnel portion;

electron gun means positioned in said neck portion to project a plurality of electron beams toward said screen along beam paths substantially parallel to said neck portion, said plurality of electron beams being positioned in line; and magnetic focusing means positioned in front of said electron gun means along the beam paths within the neck portion, and including permanent magnet means for generating a focusing magnetic field and a magnetic yoke assembly having at least first and second magnetic yoke members, each of said first and second magnetic yoke members having a plurality of cylindrical magnetic yoke portions through which said electron beams can pass respectively and a common magnetic yoke portion which surrounds all said beam paths, said magnetic yoke members being positioned in such a manner that said plurality of cylindrical magnetic yoke portions of the first magnetic yoke member are spaced from that of the second magnetic yoke member at a given distance along the beam paths, and each of the common magnetic yoke portions of said first and second magnetic yoke members reducing the strength of a radial magnetic field component of said focusing magnetic field.

2. A magnetic focussing type cathode ray tube as claimed in claim 1, in which said first and second magnetic yoke members of the magnetic yoke assembly have at least three cylindrical magnetic yoke portions respectively through which each of said electron beams can pass as a center beam and two side beams, each of said common magnetic yoke portions having a cylindrical shape, the outer diameter of which is greater than a distance between side beam paths for said two side beams.

3. A magnetic focusing type cathode ray tube as claimed in claim 1, in which said first and second magnetic yoke members of the magnetic yoke assembly have at least three cylindrical magnetic yoke portions respectively through which each said electron beam can pass as center and side beams and each of said common magnetic yoke portions has a flattenedoval shape, the greatest length of said common magnetic yoke portions being greater than a distance between said beam paths for said side beams.

4. A magnetic focusing type cathode ray tube as claimed in claim 3 in which each of said common magnetic yoke portions having a flattened oval shape can surround entirely said three cylindrical yoke portions therein.

5. A magnetic focusing type cathode ray tube as claimed in claim 4 in which said permanent magnet means is constructed by at least four bar magnets which are positioned outside said beam paths for said two side beams.

6. A magnetic focusing type cathode ray tube as claimed in claim 4, in which said permanent magnet means is constructed by at least four bar magnets which are located inside said beams paths for said two side beams on said common magnetic yoke portions.

* * * * *